US008201431B2

(12) United States Patent
Blecher

(10) Patent No.: US 8,201,431 B2
(45) Date of Patent: Jun. 19, 2012

(54) METHOD AND DEVICE FOR HANDLING/TRANSPORTING WORKING ROLLS AND/OR SUPPORT ROLLS

(75) Inventor: Gerhard Blecher, Erndtebrück (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 526 days.

(21) Appl. No.: 12/087,193

(22) PCT Filed: Jan. 9, 2007

(86) PCT No.: PCT/EP2007/000118

§ 371 (c)(1),
(2), (4) Date: Sep. 2, 2008

(87) PCT Pub. No.: WO2007/080093

PCT Pub. Date: Jul. 19, 2007

(65) Prior Publication Data

US 2009/0019909 A1 Jan. 22, 2009

(30) Foreign Application Priority Data

Jan. 9, 2006 (DE) ..... 10 2006 001 316
Jul. 5, 2006 (DE) ..... 10 2006 030 934

(51) Int. Cl.
*B21B 31/00* (2006.01)
*B21B 31/08* (2006.01)

(52) U.S. Cl. ..... 72/237; 72/238

(58) Field of Classification Search ..... 72/238, 72/239, 237, 419, 446; 164/441, 442
See application file for complete search history.

(56) References Cited

U.S. PATENT DOCUMENTS 4,510,783 A * 4/1985 Rommen et al. ..... 72/200
6,098,439 A * 8/2000 Lecrivain ..... 72/239

FOREIGN PATENT DOCUMENTS

| | | |
|---|---|---|
| DE | 39 30 125 | 3/1991 |
| DE | 43 21 663 | 1/1995 |
| JP | 56 084108 | 7/1981 |
| JP | 60 196211 | 10/1985 |
| JP | 61 049715 | 5/1986 |

(Continued)

*Primary Examiner* — Debra Sullivan
(74) *Attorney, Agent, or Firm* — Lucas & Mercanti, LLP; Klaus P. Stoffel

(57) ABSTRACT

The invention relates to a method for handling/transporting rolls and/or supports rolls in a roll workshop. The invention is characterized in that the working rolls (7, 8) are pulled/displaced by means of a locomotive mechanism (9) from the roll stand (4) in the roll hall (1), via platforms (20), into the roll workshop (2), the locomotive mechanism (9) is displaced in a roll changing hole (10), the roll workshop (2) comprises, to the right and left adjacent to the roll changing hole, a support structure (26) which comprises a left part (27) and a right part (28), a changing carriage (31) is displaced on the support structure (26) and devices (32) for receiving the working rolls/working roll sets (7, 8, 35) are provided on the changing carriage (31), and/or the support rolls (5, 6) are pulled/displaced by the locomotive mechanism (9) from the roll stand (4) into the roll workshop (2); the support rolls (5, 6) are withdrawn from the roll changing hole (10); a novel support roll set is placed in the roll changing hole (10) and the novel support roll set is displaced by the locomotive mechanism (9) in the stand (4). The invention also relates to a device for carrying out said method.

14 Claims, 6 Drawing Sheets

FOREIGN PATENT DOCUMENTS

| | | |
|---|---|---|
| JP | 63 084705 | 4/1988 |
| JP | 01 306006 | 12/1989 |
| JP | H0281702 | 6/1990 |
| JP | 05 115908 | 5/1993 |
| JP | 05 123719 | 5/1993 |
| JP | 06 126308 | 5/1994 |
| JP | 06 292913 | 10/1994 |
| JP | 08 024916 | 1/1996 |
| WO | 03/015949 | 2/2003 |
| WO | 03/099479 | 12/2003 |
| WO | 2004/039512 | 5/2004 |
| WO | 2005/089972 | 9/2005 |

* cited by examiner 1
2
3
4
5
6
7
8
9
10
11
12
13
14
16
17
18
19
20
21
26

METHOD AND DEVICE FOR HANDLING/TRANSPORTING WORKING ROLLS AND/OR SUPPORT ROLLS

BACKGROUND OF THE INVENTION

The invention concerns a support structure in a roll workshop for holding the work rolls of a rolling stand, a method for handling/transporting work rolls in a roll workshop with a support structure for holding work rolls, and a method for handling back-up rolls in a roll workshop with a support structure for holding work rolls.

JP 60-196211 A discloses a roll-changing pit that connects a mill hall with a roll workshop. A locomotive, which is located in the roll-changing pit, is used to move the rolls.

JP 05-115908 A describes a roll workshop in which a relatively large number of rolls is stored.

WO 03/099 479 A1 describes a device for changing pairs of work rolls and/or pairs of back-up rolls in rolling stands, in which the back-up rolls and the work rolls are guided in the housing frame in respective chocks that can be lifted or lowered, and the pair of work rolls can be moved out by a linear actuator while being supported on the chocks. The pair of back-up rolls can be moved in or out by means of a lower back-up roll supported on a track and wheels and a roll-changing frame, which supports the upper back-up roll and is supported on the lower back-up roll. In this regard, the pair of work rolls can be coupled on the drive side of the rolling stand with a hydraulic piston-cylinder actuator that is dimensioned in its stroke length for the removal or installation distance and can be uncoupled when it has been withdrawn the required distance. Furthermore, a roll-changing frame, which has been moved in at a height level between the back-up rolls, can be coupled to the same piston-cylinder actuator, and, when the upper back-up roll and the roll-changing frame are supported on the lower back-up roll, the pair of back-up rolls can be moved out or moved back in. The cited document also describes a corresponding method.

WO 2004/039 512 A1 discloses a tractor, with which the sets of rolls are pulled into a roll workshop (RW) and moved back again. The tractor is moved by gear wheels of the tractor that engage racks.

DE 43 21 663 A1 describes a rolling mill with support plates, which are arranged on the operating side of the rolling stands, are supported on carriages, can be displaced transversely to the roll axes, and are equipped with at least two pairs of rails, which are arranged side by side for receiving sets of work rolls supported on rollers, and with changing pits arranged in front of each rolling stand, with the bottom of each changing pit being equipped with runout rails for sets of back-up rolls. In this regard, the pits are covered between the stands and the support plates with cover plates that extend the length of the pit, which can be fixed in their initial position and can be swiveled out of this initial position to change the back-up rolls, and each cover plate is provided with a . . . for moving out sets of work rolls and transferring them to one of the pairs of tracks of the respective support plates assigned to it.

WO 03/015 949 A1 describes an apparatus for changing work rolls and back-up rolls of a strip rolling mill, in which a roll-changing carriage, which can be displaced transversely to the rolling stand and holds the old sets of rolls that have been removed, makes it possible to replace the old sets of rolls with new sets of rolls. The apparatus consists of a stationary changing cylinder mounted at the floor level of the mill, whose piston rod can move in and out transversely to the rolling stand, and of an extraction carriage connected to the forward end of said piston rod and movable on said roll-changing carriage, said extraction carriage being connectable with said roll-changing carriage such that said extraction carriage and said roll-changing carriage are movable together by said changing cylinder transversely to the longitudinal path of said strip mill. In addition, a side shift cylinder that is independent of the roll-changing carriage can move a side shift table, which is installed in said roll-changing carriage, transversely to the direction of movement of the roll-changing carriage, in order to move the sets of rolls to be changed in or out of a changing position which is aligned with the center of the rolling stand.

WO 2005/089 972 A1 describes a method for changing sets of rolls in rolling stands of a mill train with several rolling stands, each of which has back-up rolls and work rolls, by supporting them on each other and then moving them out in the axial direction of a set of work rolls or a set of back-up rolls on the operating side into a roll workshop and then moving new sets of rolls back and mounting them. During this operation, the sets of worn work rolls transported by a number of separate side shift carriages that corresponds to the number of rolling stands on the operating side are successively moved by a single locomotive on a single connecting track to the roll workshop, and from there the new sets of work rolls are driven back and at changing intervals are set down on the respective side shift carriages between the rolling stands, and after clearance of the operating side by the side shift carriages, after each dismounted worn set of work rolls, the worn back-up rolls are moved out, moved to the roll workshop by crane, serviced, transported back and remounted in the assigned rolling stands. The cited document also describes a device for carrying out this method.

JP 05-123719 A discloses a support structure for holding work rolls of a rolling stand.

SUMMARY OF THE INVENTION

The objective of the invention is to propose an alternative support structure for a roll workshop for holding work rolls and alternative methods for handling work rolls and back-up rolls in a roll workshop that is equipped with a support structure of this type.

In accordance with the invention, this object is achieved by a support structure that has a changing carriage, wherein the upper side of the support structure has rails on which the changing carriage rests and can be moved, and the changing carriage is designed with devices for holding the sets of work rolls.

The invention also concerns a method for handling/transporting work rolls in a roll workshop equipped with a support structure for holding work rolls, said method comprising the following steps: the work rolls are pulled/moved with a locomotive from a rolling stand in a mill hall to the roll workshop, and the used work rolls are moved in the roll workshop into one of at least two devices for holding the work rolls, said device being connected with a changing carriage, which is moved on the upper side of the support structure.

The invention also concerns a method for handling/transporting back-up rolls in a roll workshop equipped with a support structure for holding work rolls, said support structure having a left part on the left side of a roll-changing pit and a right part on the right side of the roll-changing pit, wherein the area above the roll-changing pit is open to allow a set of back-up rolls to pass through, said method comprising the following step: the used back-up rolls are pulled/moved with the locomotive from the rolling stand into a gap between the left part and the right part of the support structure.

The two methods have the advantage that they are very flexible.

The advantage of this method is that the work rolls or sets of work rolls and/or the back-up rolls or sets of back-up rolls have to be handled only in the roll workshop. Only the mounting and dismounting of the work rolls or sets: of work rolls and/or back-up rolls or sets of back-up rolls take place in the mill hall. The other measures are carried out completely in the roll workshop. The support structure with changing carriages that is provided for this purpose makes it possible to use a smaller crane here as well.

The advantage of this device is that the work rolls or sets of work rolls and/or the back-up rolls or sets of back-up rolls are moved/transported directly from the mill hall to the roll workshop without having to be lifted and conveyed in the mill hall by a crane or having to be moved by a separate transport carriage from the mill hall to the roll workshop. It is possible to get by with and to design a smaller crane in the mill hall.

The total transport of the sets of rolls is carried out with only one hydraulic roll-changing locomotive. All of the sets of rolls are transported from the rolling stand to the roll workshop and back to the rolling stand.

Work Roll Change with Side Shifting

The apparatus for changing the work rolls is located on the operating side of the rolling mill.

The tasks of the work roll-changing apparatus consist in pulling used sets of work rolls out of the rolling stand and then, for example, transporting them as far as the roll workshop and in transporting the freshly ground sets of work rolls from the roll workshop back to the rolling stand.

The platforms arranged on both sides, on which the sets of work rolls are transported, are welded steel structures and serve as a track foundation during the roll change. The sets of work rolls are moved on these platforms to get from the rolling stand to the roll workshop or back to the rolling stand. Slide bars/slide rails are bolted onto these platforms and serve as slideways for the drawbar with the set of work rolls coupled to it. At the same time, the platforms cover the area of the roll-changing pit. They are hinged and are supported by a pivot. They are supported laterally on the foundation in order to receive a load.

Platforms of this type make it possible to carry out a work roll change with a hydraulic roll-changing locomotive, which is located in the lower region of the roll-changing pit.

The used sets of work rolls are now transported by the roll-changing locomotive from the rolling stand to the roll workshop, or the new sets of work rolls are transported to the rolling stand.

The work roll-changing locomotive that is presently used for this purpose is no longer needed.

Savings Compared to Conventional Work Roll Changing:

The complete work roll locomotive with all of its equipment, such as 4 electric motors, a=50 kW
4 gear ratios
4 pinions
2 cable drums with cable
the complete electronics/electric cylinder
mechanical treatment by E-suppliers
installation, etc.

Advantages for the Customer:

less maintenance,
hall crane in the mill hall no longer needs to be designed for the weights of the back-up rolls.

A transport carriage for transporting the sets of rolls from the mill hall to the roll workshop or back to the mill hall is no longer needed.

A weight reduction of the platforms of about 50% is realized. Furthermore, 30-*t* racks with mounting material and feather keys are no longer needed. The complicated work on the platforms for mounting the racks is eliminated.

In the preparations for changing the back-up rolls, the hall crane is needed only for opening or closing the platforms. Due to their low height (width), the opened platforms do not interfere with the operation of the hall crane.

Removal of the platforms by the hall crane is not necessary. In addition, no space needs to be provided for setting down the platforms in the halls. This means time savings as well.

Back-up Roll Change

The apparatus for changing the back-up rolls is located in the lower region of the roll-changing pit.

The tasks of the back-up roll-changing apparatus are transporting used sets of back-up rolls out of the rolling stand to the roll workshop and transporting the new sets of back-up rolls from the roll workshop back to the rolling stand.

The platforms arranged on both sides, on which the work rolls are transported, also serve as a track foundation for the roll-changing frame for the back-up rolls. The roll-changing frame for changing the back-up rolls is moved into the rolling stand on these platforms by means of the locomotive. The work roll-changing locomotive that is presently used for this purpose is no longer needed.

Savings in Connection with Changing the Back-up Rolls

The entire work roll locomotive with all of its equipment is no longer needed.

Other Savings:

Smaller hall crane in the mill hall.
The operation that consists of the mill crane lifting the sets of rolls and then setting them down on the transport carriage to transport them to the roll workshop is eliminated.
The transport carriage with its drive mechanism for moving the rolls between the mill hall and the roll workshop is no longer needed.

Roll-Changing Locomotive for Changing the Work Rolls and Back-up Rolls.

The sets of work rolls and back-up rolls are transported with the roll-changing locomotive from the rolling stand to the roll workshop and/or the new sets of rolls are transported to the rolling stand. The roll-changing locomotive is located in the lower region of the roll-changing pit and consists essentially of the housing (carriage body):

4 hydraulic motors with transmission and pinion shaft
2 hydraulic cylinders
1 bayonet catch for the work roll change
1 bayonet catch for the back-up roll change Hydraulic Roll-Changing Locomotive The back-up roll change, the work roll change, and the movement of the back-up roll-changing frame into the rolling stand are accomplished by the hydraulic roll-changing locomotive.

The work roll-changing locomotive that is presently used for this purpose is no longer needed. Even if side shifting is being used in the mill hall or the roll workshop, this locomotive transports the sets of back-up rolls and work rolls to the roll workshop or back to the rolling stand.

Savings:

Smaller hall crane
The operation that consists of the mill crane lifting the sets of rolls and then setting them down on the transport carriage to transport them to the roll workshop is eliminated.

The transport carriage with its drive mechanism for moving the rolls between the mill hall and the roll workshop is no longer needed.

A specific embodiment of the invention is explained in greater detail below with reference to the highly schematic drawings.

DETAILED DESCRIPTION OF THE INVENTION

Figures 1, 1A:
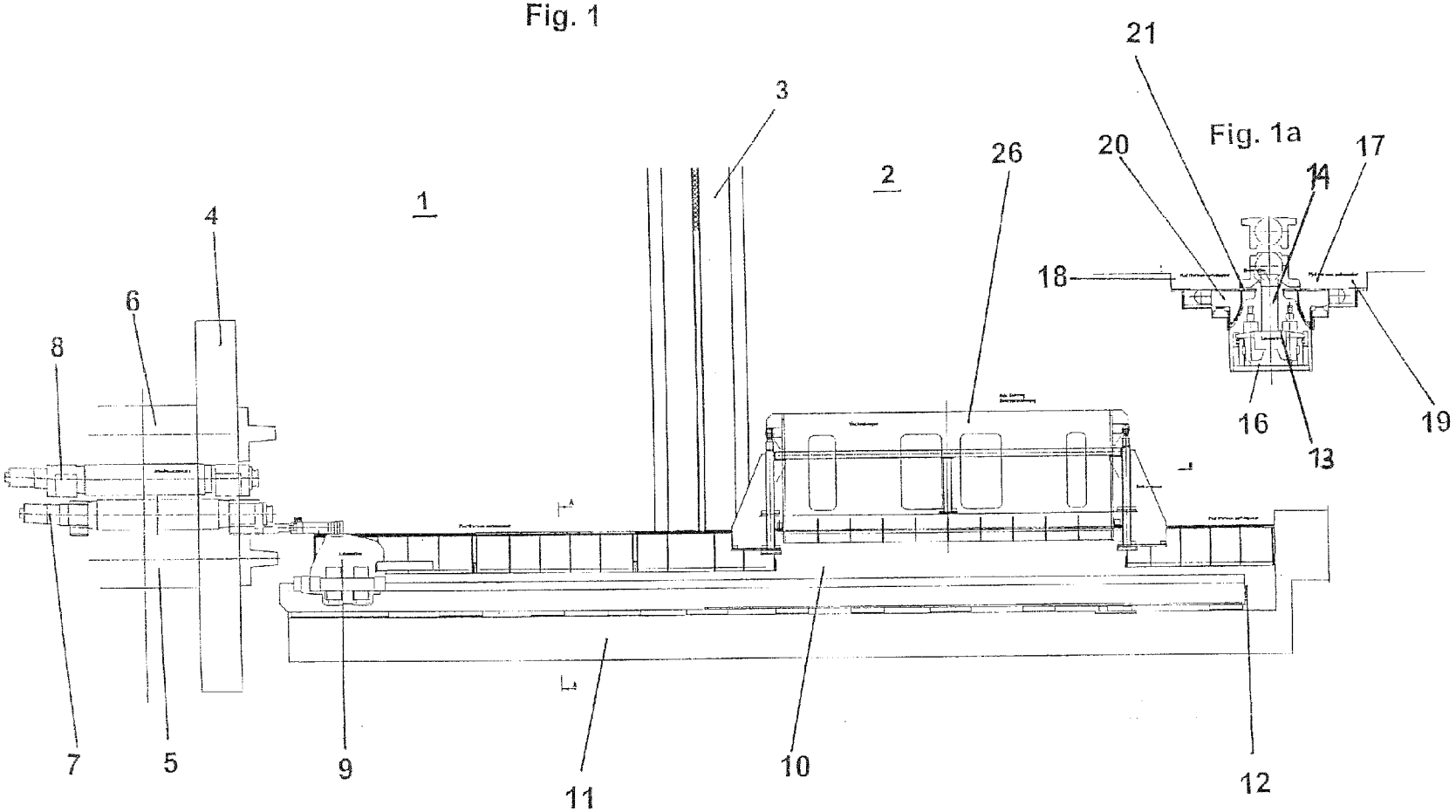
FIG. 1 shows a mill hall and roll workshop with the support structure for holding the work rolls.

FIG. 1 shows a mill hall 1 on the left side in the rolling direction and a roll workshop 2 on the right side. The two areas are separated by a wall 3. A lower back-up roll 5, an upper back-up roll 6, a lower work roll 7 and an upper work roll 8 are mounted in a rolling stand 4. A locomotive 9 is used to transport rolls from the rolling stand 4 in the mill hall 2 to the roll workshop 2, for example, in order to regrind the rolls. The locomotive 9 is located in a pit 10, which connects the mill hall 1 and the roll workshop 2. All of the equipment, such as rails, etc., is installed on a foundation or several foundations 11. The locomotive 9 can thus be moved from a waiting position 12 at the right end of the pit to the rolling stand 4. FIG. 1*a* is a cross-sectional view that shows how the locomotive 9 is installed in the pit 10. As the drawing shows, the pit 10 is divided into a lower, narrow region 16 and an upper, wide region 17. The lower, narrow region 16 is only slightly wider than the locomotive 9. The upper, wide region 17 has platforms 20 at its two edges 18, 19. The platforms 20 are moved downward when a set of work rolls 7, 8 is being removed or transported. The upper sides of the platforms 20 have guide rails 21, on which the set of rolls 7, 8 can be moved. The platforms 20 are separated by a distance that allows a coupling device 14 mounted on the upper side 13 of the locomotive 9 to pass through. To transport the set of back-up rolls 5, 6, which have larger diameters, the platforms 20 are opened upward and thus widened to allow the rolls to pass through. FIG. 1 shows a design in which the work rolls 7, 8 are pulled directly into the roll workshop 2. The platforms 20 are moved downward to allow the rolls to move over them. A support structure 26 is located in the roll workshop 2. It facilitates the handling/transport of the work rolls during their treatment in the roll workshop 2. As is apparent, the work rolls 7, 8 are moved into the support structure 26 for this purpose.

Figure 2:
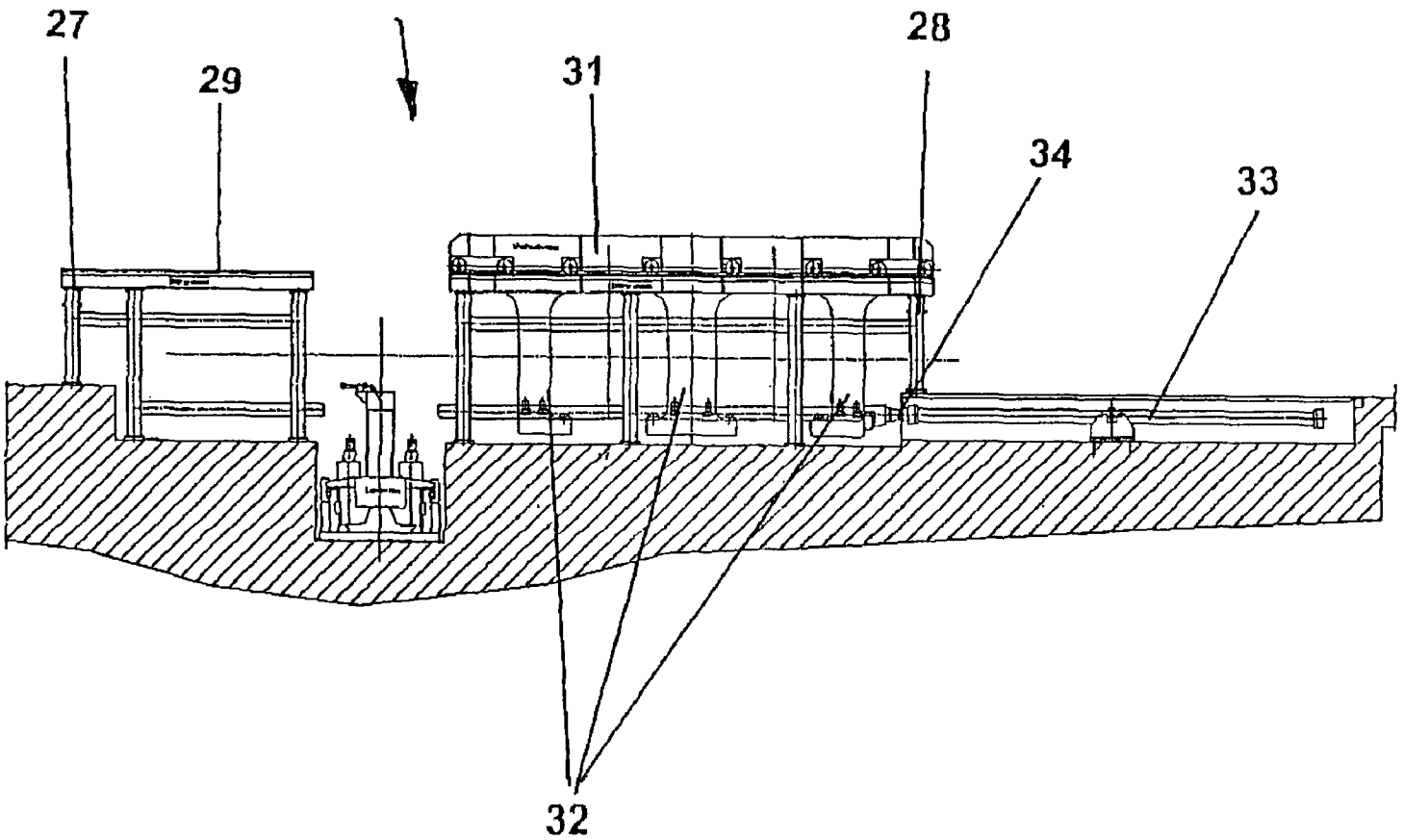
FIG. 2 shows a side view of the support structure, viewed towards the wall, with the changing carriage mounted on it, said changing carriage having downwardly directed devices for holding the work rolls.

The support structure 26 is shown in greater detail in FIG. 2. The support structure 26 consists of a left part 27 and a right part 28, which are constructed on the left and right side of the roll-changing pit 10. The area above the roll-changing pit 10 is open. This allows a set of back-up rolls to pass through. Rails 30, on which a changing carriage 31 rests, are mounted on the upper side 29. The underside of the changing carriage 31 has devices 32 for holding the work rolls 7, 8. Since both a used and a new set of work rolls are simultaneously present in the support structure 26, at least two devices 32 for holding them are provided. The changing carriage 31 with the devices 32 is moved laterally by means of a hydraulic cylinder 33 and a connecting rod 34. In this regard, in a first design, the connecting rod 34 is connected with the right side of the device 32 for holding the work rolls 7, 8.

Figure 3:
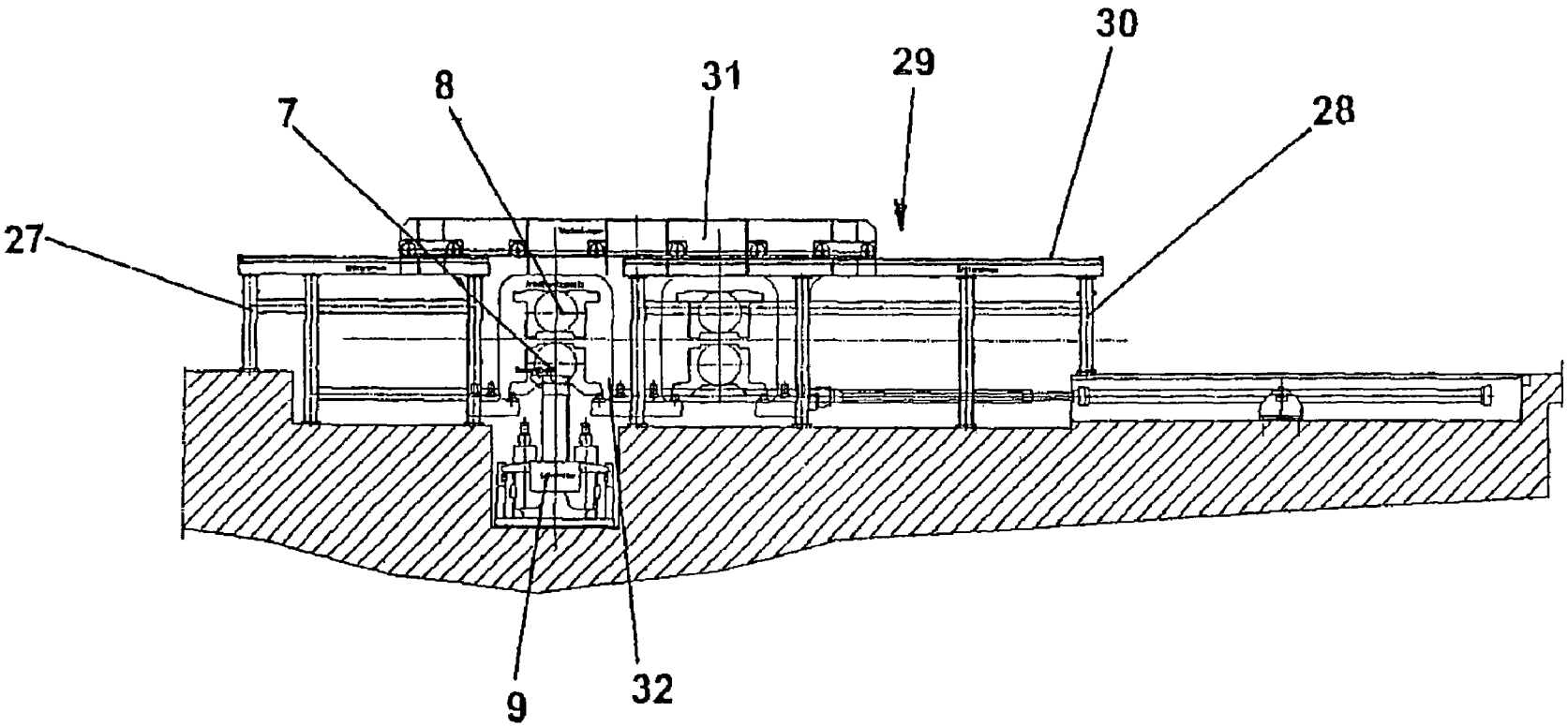
FIG. 3 shows the support structure in position to receive the removed set of work rolls.

As FIG. 3 shows, in a first position, a used set of work rolls 7, 8 is received by the left device 32 and lifted, i.e., coupled with the locomotive 9. During this operation, the changing carriage 31 rests on the left part 27 and the right part 28 of the support structure 26.

Figure 4:
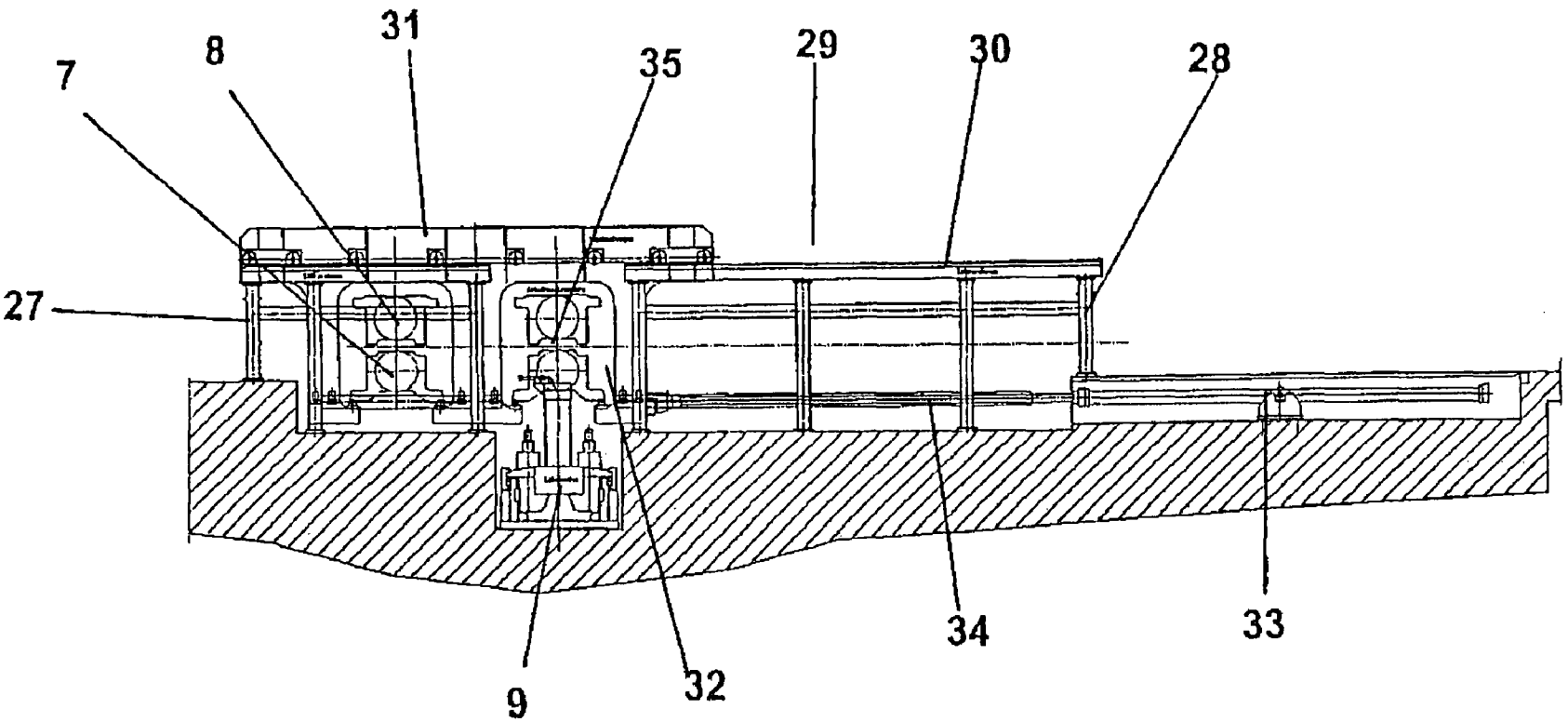
FIG. 4 shows the support structure in position to deliver a new set of work rolls.

As FIG. 4 shows, a reground/new set of work rolls 35, which is already positioned in the right device 32, is pushed to the left so as to line up with the locomotive 9. It is then lowered onto the platforms 20 with the rails and pushed into the rolling stand 4 (not shown in FIG. 4). The support structure 26 with the changing carriage 31 and with the devices 32 for holding the work rolls, which devices 32 are located on said changing carriage 31, makes it possible to dispense with a hall crane.

Figure 5:
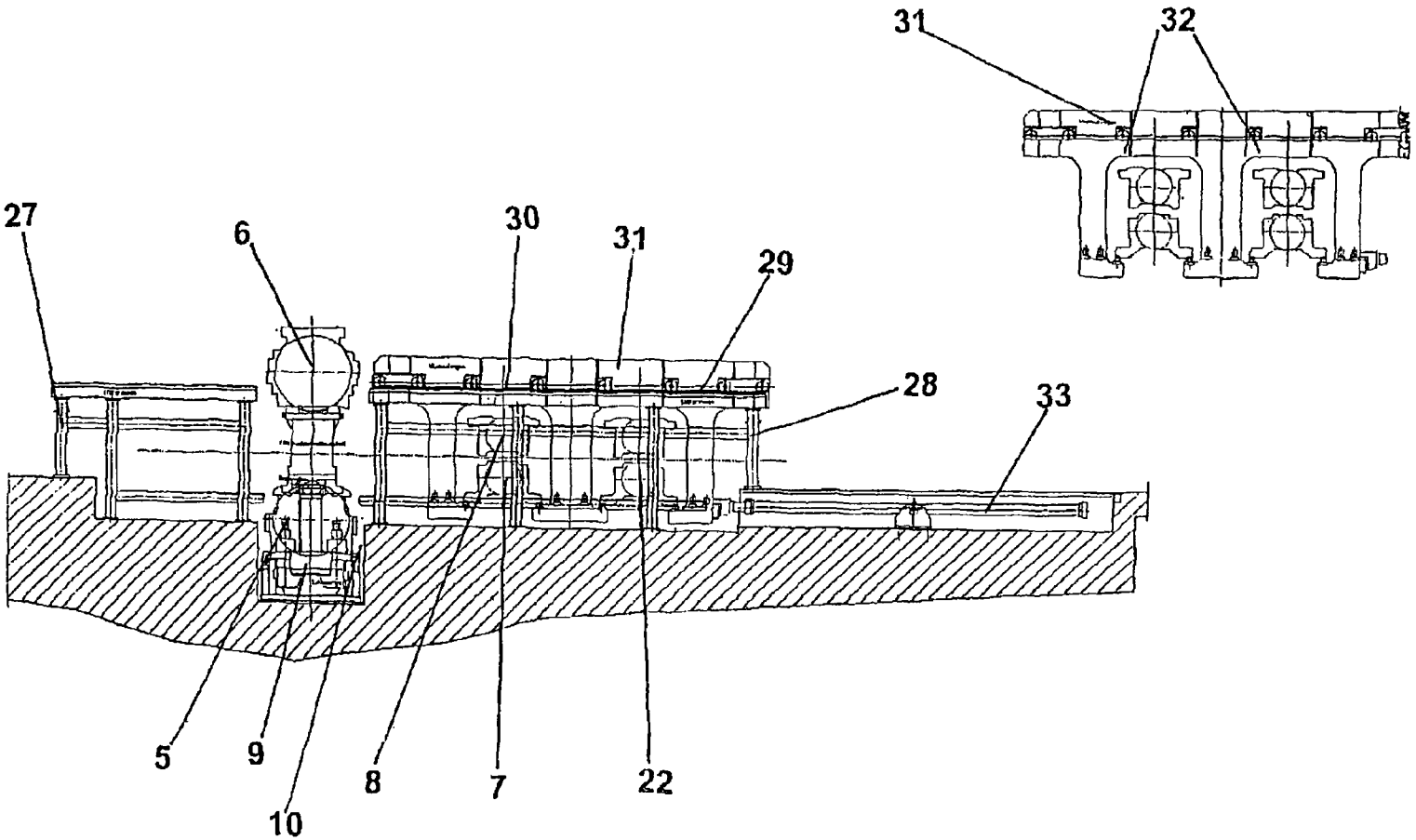
FIG. 5 shows the support structure with changing carriage in the roll workshop during the run-in of a set of back-up rolls.

As shown in FIG. 5, the hall crane is again needed for handling the back-up rolls. To move the back-up rolls into the roll workshop 2, the changing carriage 31 with the devices 32 is moved to the right in such a way that a gap arises between the left part 27 and the right part 28 of the support structure. The set of back-up rolls can be pulled into this gap by means of the locomotive 9. The gap between the left part 27 and the right part 28 of the support structure 26 can be freed by a special design of the changing carriage 31 with several rollers and a suitable length. The changing carriage 31 is moved on rails 30 on the upper side 29 of the support structure 26. Devices 32 are mounted on the underside of the changing carriage 31. The design of said devices 32 allows the work rolls 7, 8, 22 to be moved in and to be supported. The devices 32 are built, for example, as steel structures.

Figure 6:
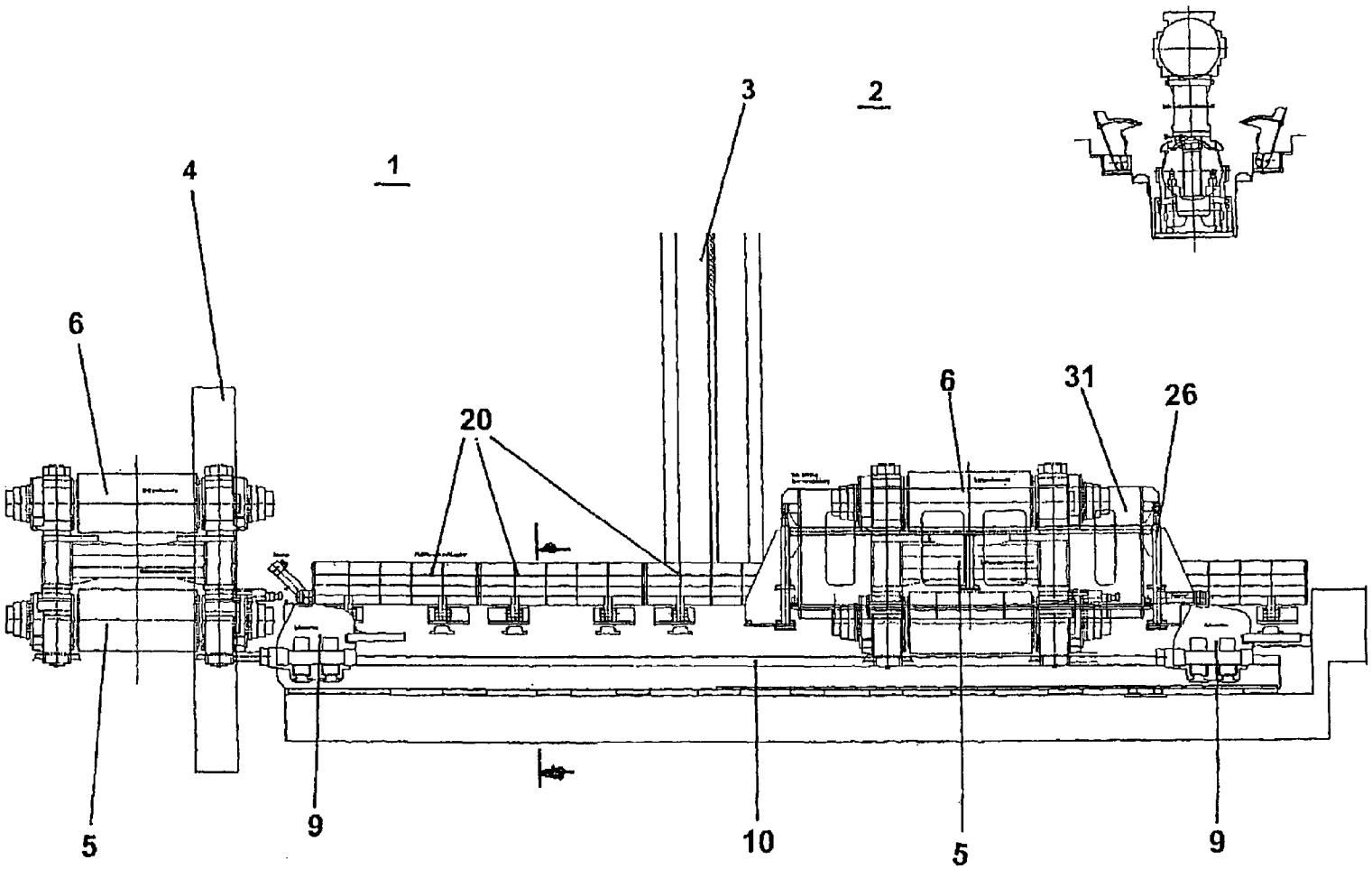
FIG. 6 shows the mill hall and roll workshop with the support structure for holding the work rolls and with the back-up rolls run into the support structure.

FIG. 6 shows a design in which the back-up rolls 5, 6 are pulled directly into the roll workshop. The platforms 20 in the mill hall 1 and in the roll workshop 2 are opened upward to allow the rolls to pass through. A support structure 26, which simplifies the handling during the treatment of the individual work rolls, is located in the roll workshop 2. The support structure 26 is used exclusively for handling the work rolls. The back-up rolls 5, 6 extend beyond the upper edge of the changing carriage 31. This drawing again shows how the locomotive 9 is coupled to the lower back-up roll 5 in the mill hall 1. Only one locomotive 9 is provided in the roll-changing pit 10, but the drawing also shows it in another position on the right side, in the roll workshop 2. This is its parking or waiting position. The locomotive 9 is shown just as it has been uncoupled from the back-up rolls 5, 6. A cross section of the mill hall 1 is shown at the upper right. The platforms 20 are opened upward to allow the back-up rolls 5, 6 to pass through the roll-changing pit 10 into the roll workshop 2.

LIST OF REFERENCE NUMBERS

1 mill hall
2 roll workshop
3 wall
4 rolling stand
5 lower back-up roll
6 upper back-up roll
7 lower work roll
8 upper work roll
9 locomotive

10 roll-changing pit
11 foundation
12 waiting position
13 upper side
14 coupling device
15 connecting rod
16 narrow region
17 wide region
18 edge
19 edge
20 platform
21 guide rail
22 set of work rolls
23 shift platform
24 rolls
25 roll-changing frame
26 support structure
27 left part
28 right part
29 upper side
30 rails
31 changing carriage
32 device
33 hydraulic cylinder
34 connecting rod
35 set of work rolls

The invention claimed is:

1. A support structure in a roll workshop for holding work rolls of a rolling stand, wherein the support structure (26) has a changing carriage (31) with a bottom having an opening, an upper side (29) of the support structure (26) has rails (30) on which the changing carriage (31) rests and can be moved, and the changing carriage (31) is designed with at least two devices (32) for holding the sets of work rolls (7, 8, 22), wherein the devices (32) for holding the sets of work rolls (7, 8, 22) are only mounted on a bottom end of the changing carriage (31) so as to straddle the opening in the bottom and are designed in such a way that the work rolls (7, 8) can be moved into and supported in the device (32).

2. A support structure in accordance with claim 1, wherein the support structure (26) has a left part (27) on a left side of a roll-changing pit (10) and a right part (28) on a right side of the roll-changing pit (10) and that an area above the roll-changing pit (10) is open to allow a set of support rolls to pass through.

3. A support structure in accordance with claim 2, wherein the changing carriage (31) is designed with several rollers (36) and with a length such that a gap can be opened between the left part (27) and the right part (28) of the support structure (26) for a set of support rolls (5, 6).

4. A support structure in accordance with claim 1, wherein at least two devices (32) are provided for simultaneously holding both a used and a new set of work rolls (7, 8, 22).

5. A support structure in accordance with characterized by claim 1, comprising a hydraulic cylinder (33) with a piston rod (34) for lateral displacement of the changing carriage (31) with the devices (32).

6. A device for handling and transporting working rolls, comprising a support structure in a roll workshop for holding work rolls of a rolling stand, wherein the support structure (26) has a changing carriage (31) with a bottom having an opening, an upper side (29) of the support structure (26) has rails (30) on which the changing carriage (31) rests and can be moved, and the changing carriage (31) is designed with at least two devices (32) for holding the sets of work rolls (7, 8, 22), wherein the devices (32) for holding the sets of work rolls (7, 8, 22) are only mounted on the bottom end of the changing carriage (31) so as to straddle the opening in the bottom and are designed in such a way that the work rolls (7, 8) can be moved into and supported in the device (32), wherein the support structure (26) has a left part (27) on a left side of a roll-changing pit (10) and a right part (28) on a right side of the roll-changing pit (10) and that an area above the roll-changing pit (10) is open to allow a set of support rolls (5, 6) to pass through, wherein the roll-changing pit (10) connects the roll workshop (2) with a mill hall (1), in which the rolling stand (4) is located, and a locomotive (9) can be moved in the roll-changing pit (10) for transporting the set of work rolls (7, 8, 22) or the set of support rolls (5, 6) from the rolling stand (4) to the roll workshop (2) or back to the rolling stand (4).

7. A device in accordance with claim 6, wherein the roll-changing pit (10) is divided into a lower, narrow region (16) and an upper, wide region (17) and the lower, narrow region (16) is only slightly wider than the locomotive (9).

8. A device in accordance with claim 7, wherein the roll-changing pit (10) has platforms (20) at two edges (18, 19) in the upper, wide region (17), said platforms (20) are opened downward during the transport of the work rolls (7, 8) and upward during the transport of the support rolls (5, 6), and the platforms have guide rails (21) on their upper sides and are separated by a certain distance.

9. A device in accordance with claim 8, wherein the platforms (20) are constructed as welded steel structures and are laterally supported on a foundation (11) to allow them to support a load.

10. A method for handling/transporting work rolls in a roll workshop equipped with a support structure for holding work rolls, wherein the work rolls (7, 8) are pulled/moved with a locomotive (9) from a rolling stand (4) in a mill hall (1) to the roll workshop (2), used work rolls (7, 8) are moved in the roll workshop (2) into one of at least two devices (32) for holding the work rolls (7, 8), and said devices (32) are connected with a changing carriage (31), which is moved on the upper side (29) of the support structure (26), wherein the devices (32) for holding the sets of work rolls (7, 8, 22) are only mounted on a bottom end of the changing carriage (31) so as to straddle the opening in the bottom and are designed in such a way that the work rolls (7, 8) can be moved into and supported in the devices (32).

11. A method in accordance with claim 10, wherein the two devices (32) are provided for simultaneously holding both a used and a new set of work rolls (7, 8, 22) and a reground/new set of work rolls (22), which is already positioned in a right hand side device of the two devices (32), is pushed to the left to come in line with the locomotive (9) and is then lowered onto platforms (20) with rails (21) over a roll-changing pit (10) and pushed into the rolling stand (4).

12. A method for handling/transporting support rolls (5, 6) in a roll workshop (2) equipped with a support structure (26) for holding work rolls (7, 8, 22), wherein the support structure (26) has a left part (27) on a left side of a roll-changing pit (10) and a right part (28) on a right side of the roll-changing pit (10), and an area above the roll-changing pit (10) is open to allow a set of support rolls (5, 6) to pass through, said method comprising the following step:

pulling/moving used support rolls (5, 6) with a locomotive (9) from a rolling stand (4) into a gap between the left part (27) and the right part (28) of the support structure (26), wherein devices (32) for holding sets of work rolls (7, 8, 22) are only mounted on a bottom end of a changing carriage (31) so as to straddle an opening in the bottom and are designed in such a way that the work rolls (7, 8) can be moved into and supported in the devices (32).

13. A method in accordance with claim 12, wherein the used support rolls (5, 6) are lifted with a crane from the roll-changing pit (10) in the roll workshop (2).

14. A method in accordance with claim 13, wherein a new set of support rolls is placed in the roll-changing pit (10) and is moved into the rolling stand (4) by the locomotive (9).

* * * * *